US005405442A

United States Patent [19]

Korokeyi

[11] Patent Number: 5,405,442

[45] Date of Patent: Apr. 11, 1995

[54] LIQUID PASSAGE SYSTEM FOR PHOTOGRAPHIC COATING DEVICES

[75] Inventor: Solomon T. Korokeyi, Rochester, N.Y.

[73] Assignee: Eastman Kodak Company, Rochester, N.Y.

[21] Appl. No.: 166,680

[22] Filed: Nov. 15, 1993

Related U.S. Application Data

[63] Continuation of Ser. No. 856,781, Mar. 24, 1992, abandoned.

[51] Int. Cl.[6] ..... B05C 5/00

[52] U.S. Cl. ..... 118/325; 118/412; 118/419; 118/DIG. 4

[58] Field of Search ..... 118/50, 325, 324, 410, 118/411, 412, 419, 420, DIG. 4; 427/420; 430/935

[56] References Cited

U.S. PATENT DOCUMENTS

| | | | |
|---|---|---|---|
| 2,761,417 | 9/1956 | Russell et al. | 118/410 |
| 3,005,440 | 10/1961 | Padday | 118/412 |
| 3,474,758 | 10/1969 | Russell | 118/412 |
| 3,749,053 | 7/1973 | Timson | 118/50 |
| 4,041,897 | 8/1977 | Ade | 118/300 |
| 4,283,443 | 8/1981 | Choinski | 118/411 |
| 4,287,240 | 8/1981 | O'Connor | 118/325 |
| 4,292,349 | 9/1981 | Ishiwata et al. | 118/410 |
| 5,143,758 | 9/1992 | Devine | 118/DIG. 4 |

FOREIGN PATENT DOCUMENTS

| | | | |
|---|---|---|---|
| 484980 | 5/1992 | European Pat. Off. | 430/935 |
| 4-1649 | 1/1992 | Japan | 430/935 |

OTHER PUBLICATIONS

Y. Harazaki, "Progress of Coating Technique", *Extension Technology Service Center, Inc.*, p. 359 (1988), month unknown.

*Primary Examiner*—Joseph W. Drodge
*Attorney, Agent, or Firm*—Nixon, Hargrave, Devans & Doyle; Carl F. Ruoff

[57] ABSTRACT

The present invention relates to a coating hopper for applying one or more layers of photographic liquid onto a web of paper or film support. The device incorporates a liquid passage system with a metering slot of defined width which leads to an expansion section having an increasing width as liquid moves away from the metering slot. The expansion section is connected to a discharge slot having a defined width greater than that of the metering slot which delivers photographic liquid to a location on the coating device where a layer of that liquid is formed.

20 Claims, 3 Drawing Sheets

LIQUID PASSAGE SYSTEM FOR PHOTOGRAPHIC COATING DEVICES

This application is a continuation of application Ser. No. 07/856,781, filed Mar. 24, 1992, now abandoned.

FIELD OF THE INVENTION

The present invention relates to a device for applying liquid photographic coatings to a paper or film support.

BACKGROUND OF THE INVENTION

In producing photographic film or paper, it is necessary to coat the film or paper support with discrete layers of photographic coatings. Some of these layers contain a radiation sensitive material like silver halides, diazonium salts, and light sensitive dyes as well as other photographic additives including matting agents, developing agents, mordants, etc. Other layers may contain materials which are not radiation sensitive like subbing layers, pelloid protective layers, filter layers, antihalation layers, and interlayers. Additionally, hydrophilic colloids, polysaccharides, surfactants, and synthetic polymers may also be incorporated in photographic coating liquids.

The number of separate and discrete layers of photographic coatings applied to photographic paper or film support depends on the product's design. Typically, the number of layers varies between 1 to 15, more usually 3 to 13.

A slide hopper is a known apparatus which will coat one or more liquids onto a solid support. The conventional multi-slide hopper performs its coating operation by metering a first coating liquid from a supply through a narrow slot which distributes the liquid uniformly across the top of a downwardly inclined slide surface. This layer of liquid moves down the slide surface by gravity to supply a steady, uniform, smooth coating layer to a coating bead across which it is applied to a moving web being coated. A second coating liquid is supplied to and distributed by, a second slot which directs a uniform layer of that liquid onto the top of a second slide surface. The second coating liquid first flows down its own slide surface and then onto the top of the layer of liquid issuing from the first slot without interlayer mixing. The layers of the first and the second liquids then together flow down to a coating bead where they are applied to the web. Additional liquids may be coated simultaneously by equipping the hopper with the appropriate number of slots and slide surfaces.

Instead of applying photographic coatings from a multi-slide hopper to a web by use of a coating bead, multi-layer photographic coatings can be applied by passing the web beneath a liquid curtain formed by discharging the coating liquid from a terminal lip portion of the multi-slide hopper. Both the bead coating and curtain coating techniques are well known, as disclosed e.g., in U.S. Pat. No. 4,287,240 to O'Connor.

In older photographic coating hopper arrangements, photographic liquids were pumped from a narrow feed conduit into a distribution channel where the liquid was spread transversely across the hopper. From the distribution channel, the photographic liquid was passed through a metering slot of constant width and discharged onto a slide surface. U.S. Pat. No. 2,761,417 to Russell et al. depicts such a system.

It has been found that such conventional hoppers often tend to produce a defect in the final coating product which appears as a long line or lines running parallel to the direction of coating. These defects are not always visible in the product as coated and very often they become visible only after the product is dried and/or processed (if the coating web is a photographic product) and then is visually checked. One cause of such streaks is local deficiencies in the layer of coating liquid issuing from any slot which is thinner than the adjacent layer of coating liquid. The total thickness of the layers is constant throughout the coatings. Streaks may also result from the entrapment of particles and bubbles in areas of the coating system having low wall shear stress or regions of recirculation (i.e., vortices).

In U.S. Pat. No. 3,005,440 to Padday, the line problem was attacked by terminating the metering slot at a discharge slot which abruptly widens at a right angle to the metering slot. This sharp right-angle corner produces the maximum amount of turbulence in the stream and heals lines formed by upstream blockages in the metering slot. With this configuration, any flow obstructing particles will be present only in the metering slot having a narrow width to maintain backpressure on the upstream distribution channel. The length of the wider discharge slot is sufficient to heal any turbulence created by blockages in the metering slot. Studies, however, indicate that streak-creating vortices can occur in the discharge slot at slot Reynolds Numbers of 5 or above.

Another approach to elimination of lines, as discussed in U.S. Pat. No. 3,474,758, is to direct the exit end of the discharge slot at an angle to the slide surface on which liquid from the slot exits. Somewhat similar to this concept is the device disclosed in U.S. Pat. No. 4,041,897 to Ade where each emulsion is applied to a slide on the device through a slot having a vertically-extending upstream wall and an inclined downstream wall such that the slot widens as it approaches the slide. Such techniques, however, are susceptible to the adherence of streak-forming particles to the incline.

Streaking is thus a significant problem in processes of coating a pack of photographic emulsion layers onto a support. There continues to be a need for an economical and effective procedure for correcting this problem.

SUMMARY OF THE INVENTION

The present invention relates to a coating device which can be used to apply one or more layers of photographic liquids onto a web of paper or film support. The device includes a liquid passage system which contains a metering slot having a defined, preferably, narrow width to maintain an upstream back pressure. Downstream of the metering slot is an expansion section which has a smoothly increasing width as liquid moves away from the metering slot. This width expansion can have a configuration which is linear or non-linear (e.g., exponential). A discharge slot connected to the expansion section has a defined, preferably, constant width which is greater than the width of the metering slot. The discharge slot delivers photographic liquid to a location in the coating device where a layer of that liquid is formed.

The liquid passage system of the present invention is particularly useful in conjunction with a slide hopper. Such devices have a liquid-applying plate and a plurality of spaced, serially-arranged, layering plates defining a planar incline which directs layers formed on the incline to a coating application area. The liquid passage system of the present invention, which can be located between each of the layering plates and between the liquid-applying plate and its adjacent layering plate, supplies liquid-forming layers to the incline. Such hoppers can be used to apply photographic coatings to a support by either curtain coating or bead coating.

DETAILED DESCRIPTION OF THE DRAWINGS

Figure 1:
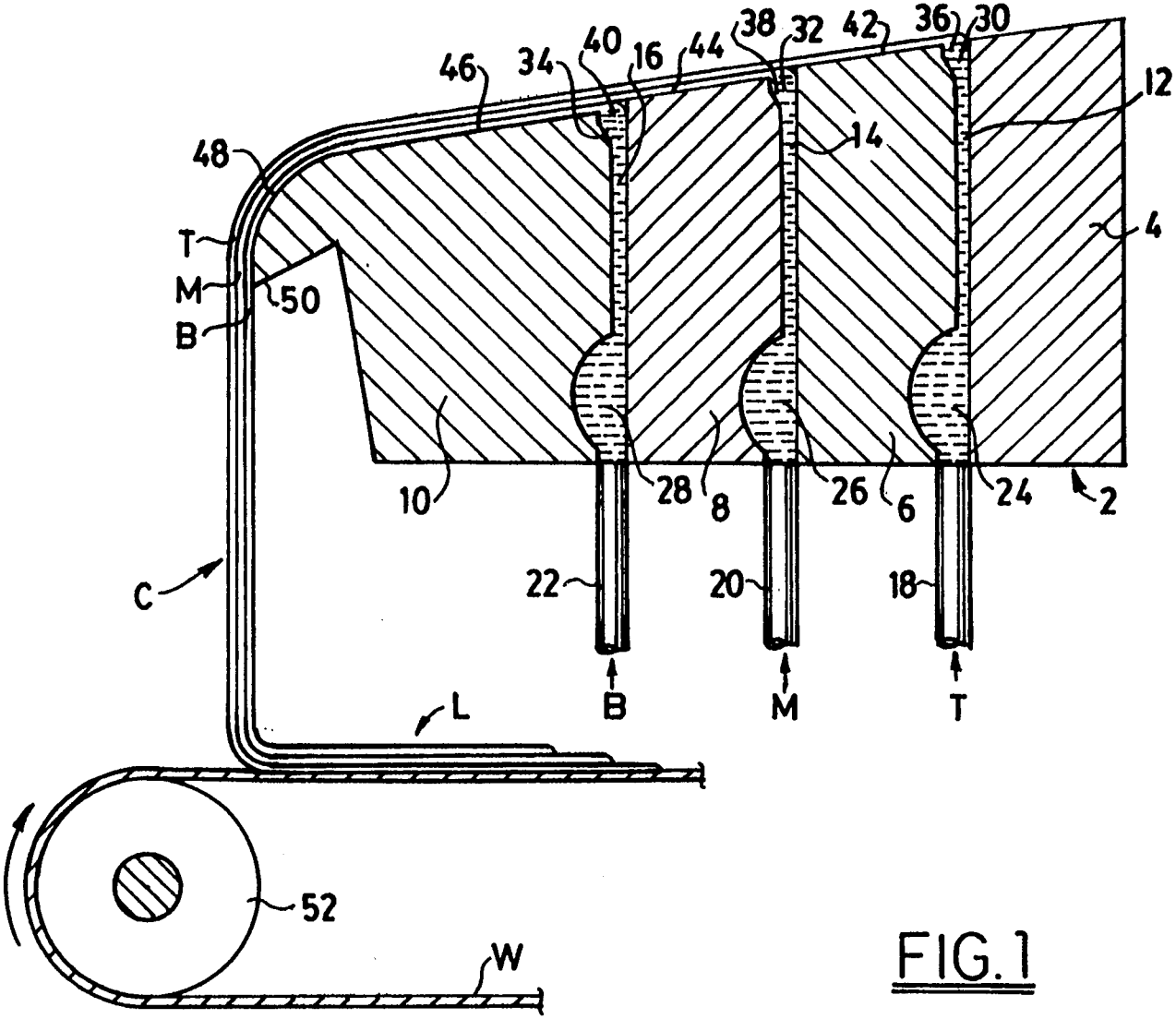
FIG. 1 is a side cross-sectional view of a curtain coating slide hopper in accordance with the present invention.

FIG. 1 is a side cross-sectional view of a photographic liquid coating slide hopper 2 in accordance with the present invention. Slide hopper 2 includes layering plates 4, 6, and 8 and curtain-forming plate 10. Layering plates 6 and 8 and curtain-forming plate 10 have upper planar surfaces 42, 44, and 46, respectively, which together form a wide incline at an angle of from 5 to 20 degrees, preferably 15 degrees, from horizontal. Protruding from the end of curtain-forming plate 10 which is distal from the layering plates is vertical lip 50.

The spaces between layering plates 4, 6, and 8 and between layering plate 8 and curtain-forming plate 10 form passages for supplying photographic liquids to the incline formed by upper planar surfaces 42, 44, and 46. For top liquid T, this passage, which extends transversely to slide hopper 2 (i.e. into and out of FIG. 1), is defined by the space between layering plates 4 and 6 and includes primary distribution channel 24, metering slot 12, expansion section 30, and discharge slot 36, all of which extend transversely of hopper 2. Liquid T is fed to primary distribution channel 24 by feed conduit 18 which has a central or side location relative to the transverse extent of channel 24 across the width of hopper 2. As to middle liquid M, the space between layering plates 6 and 8, defined by primary distribution channel 26, metering slot 14, expansion section 32, and discharge slot 38, all of which extend transversely across hopper 2, constitutes the passage. Liquid M is supplied to primary distribution channel 26 by feed conduit 20 which is located centrally or at the end of the transverse extent of channel 26. Bottom liquid B's passage is between layering plate 8 and curtain-forming plate 10 and includes distribution channel 28, metering slot 16, expansion section 34, and discharge slot 40, all extending transversely of hopper 2. Feed conduit 22 supplies liquid B to primary distribution channel 28 and has a central or side location with respect to the transverse extent of channel 28 across the width of hopper 2. For liquids T, M, and B, the distribution channels reduce the resistance to transverse flow of liquid across hopper 2, while a high resistance to longitudinal flow is maintained by metering slots. As a result, liquid layers flowing onto the incline defined by planar surfaces 42, 44, and 46 are spread to a suitable width and have a high level of uniformity due to the substantial reduction in pressure variation achieved by the distribution channels. Instead of providing each photographic liquid passage with a single distribution channel, it is particularly desirable to utilize a pair of serially-arranged distribution channels (not shown) in each passage may be of the type disclosed in U.S. patent application Ser. No. 07/766,945, now U.S. Pat. No. 5,234,500, entitled "Liquid Distribution System for Photographic Coating Devices" to Solomon T. Korokeyi.

As is apparent from FIG. 1, top liquid T is discharged from discharge slot 36 onto planar surface 42. In turn, middle liquid M is deposited on and in contact with planar surface 44 beneath top liquid T. Likewise, bottom liquid B is deposited on and in contact with planar surface 46 of curtain-forming plate 10 beneath middle liquid M and top liquid T. Once applied to the incline defined by the upper planar surfaces of layering plates 4, 6, and 8 and curtain-forming plate 10, liquids B, M, and T maintain their identity as separate and discrete layers.

The separate and discrete layers of liquids B, M, and T flow down planar surface 46, around transition section 48 and fall from lip 50 as a curtain C of liquid coating onto web W as layer L. Web W is transported into contact with curtain C by drive roller 52.

Figure 2:
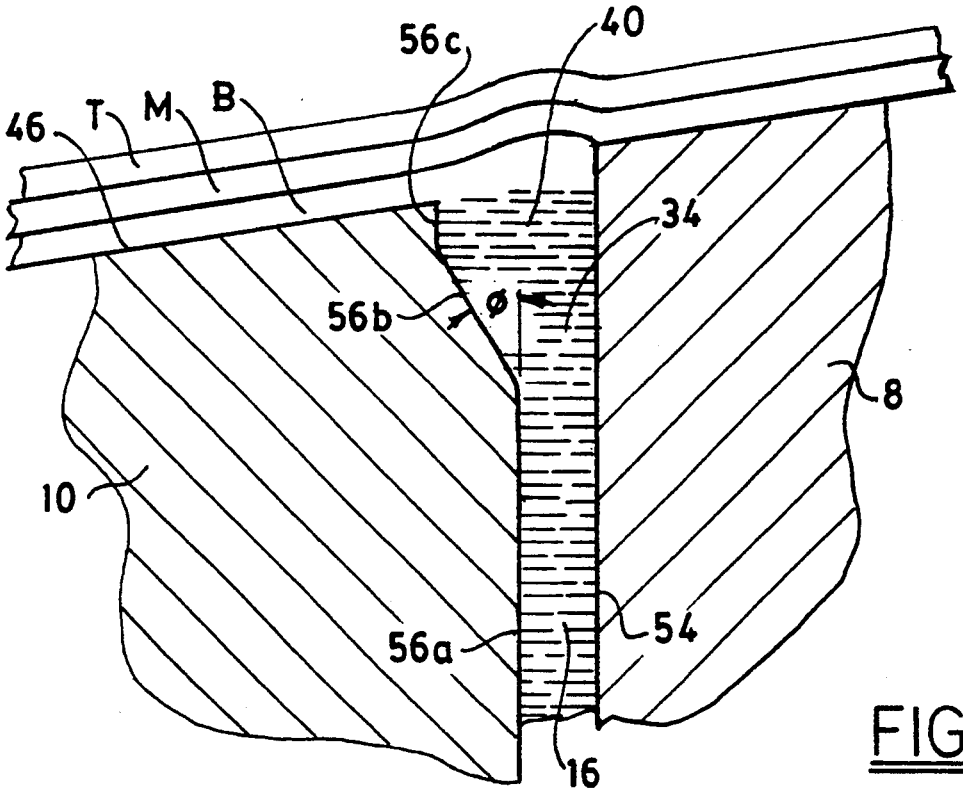
FIG. 2 is a side cross-sectional view of a liquid passage system of the slide hopper of FIG. 1.

FIG. 2 is a side cross-sectional view of the liquid passage system between plates 8 and 10 of the slide hopper of FIG. 1. As depicted, metering slot 16 is defined by upstream wall 54 and wall section **56*a* which are in parallel planes. Connected to metering slot 16 is expansion section 34 which is also defined by upstream wall 54 as well as wall section 56*b*. Discharge slot 40, which receives liquid from expansion section 34, is defined by wall section 56*c* and upstream wall 54 which are in parallel planes. Liquid emerging from discharge slot 40 onto upper planar surface 46 of curtain-forming plate 10** forms a layer of bottom liquid B. The liquid passage systems which form the layer of top liquid T and the layer of middle liquid M are similarly configured.

The angle $\phi$ at which wall section **56*b* is inclined from wall section 56*a* ranges from 5° to 45°, preferably 25°. The perpendicular distance between upstream wall 54 and wall section 56*a* is 0.1 to 0.6 mm, preferably 0.25 mm, and is substantially constant. The perpendicular distance between upstream wall 54 and wall section 56*c* is also substantially constant and ranges from 0.5 to 1.5 mm, preferably 0.9 mm. The length of wall section 56*c* between where it contacts wall section 56*b* and upper planar surface 46 ranges from 1.5 to 4.5 mm, preferably 2.7 mm. To avoid low wall shear stress and regions of flow recirculation, the location where wall section 56*a* meets wall section 56*b* and where wall section 56*b* meets wall section 56*c*** are not defined by sharp edges but, rather, by rounded transition surfaces.

Figure 3:
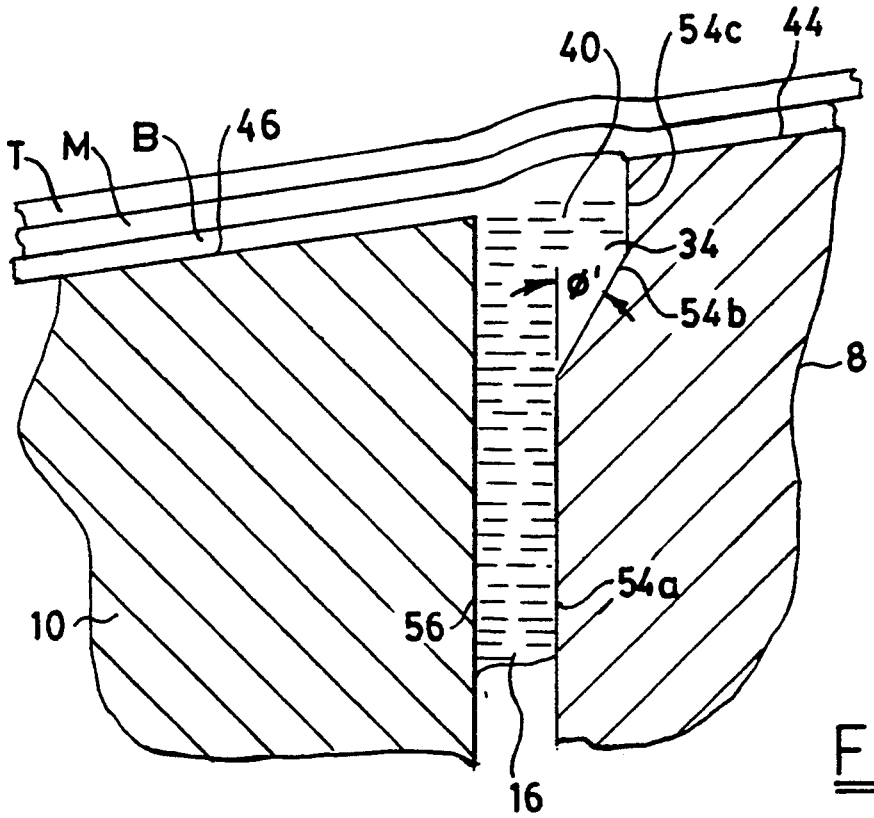
FIG. 3 is a side cross-sectional view of a second embodiment of a liquid passage system in accordance with the present invention.

FIG. 3 is a side cross-sectional view of a second embodiment of a liquid passage system in accordance with the present invention. This configuration is essentially the same as that depicted in FIG. 2 except that the passage expands in the upstream direction. As depicted, metering slot 16 is defined by downstream wall 56 and wall section **54*a*. Expansion section 34 is connected to metering slot 16 and is defined by downstream wall 56 and wall section 54*b*. From expansion section 34, liquid enters discharge slot 40 which is defined by wall section 54*c* and downstream wall 56. As in FIG. 2, liquid emerging from discharge slot 40 flows onto planar surface 46 of curtain-forming plate 10** as a layer of bottom liquid B.

The angle $\phi'$ at which wall section **54*b* is inclined from wall section 54*a* ranges from 5° to 45°, preferably 25°. The perpendicular distance between downstream wall 56 and wall section 54***a* is 0.1 to 0.6 mm, preferably 0.25 mm, and is substantially constant. The perpendicular distance between downstream wall 56 and wall section 54*c* is also substantially constant and ranges from 0.5 to 1.5 mm, preferably 0.9 mm. The length of wall section 54*c* between where it contacts wall section 54*b* and upper planar surface 44 ranges from 1.5 to 4.5 mm, preferably 2.7 mm. Like the embodiment of FIG. 2, wall sections 54*a*, 54*b*, and 54*c* are joined by rounded transition surfaces.

Figure 4:
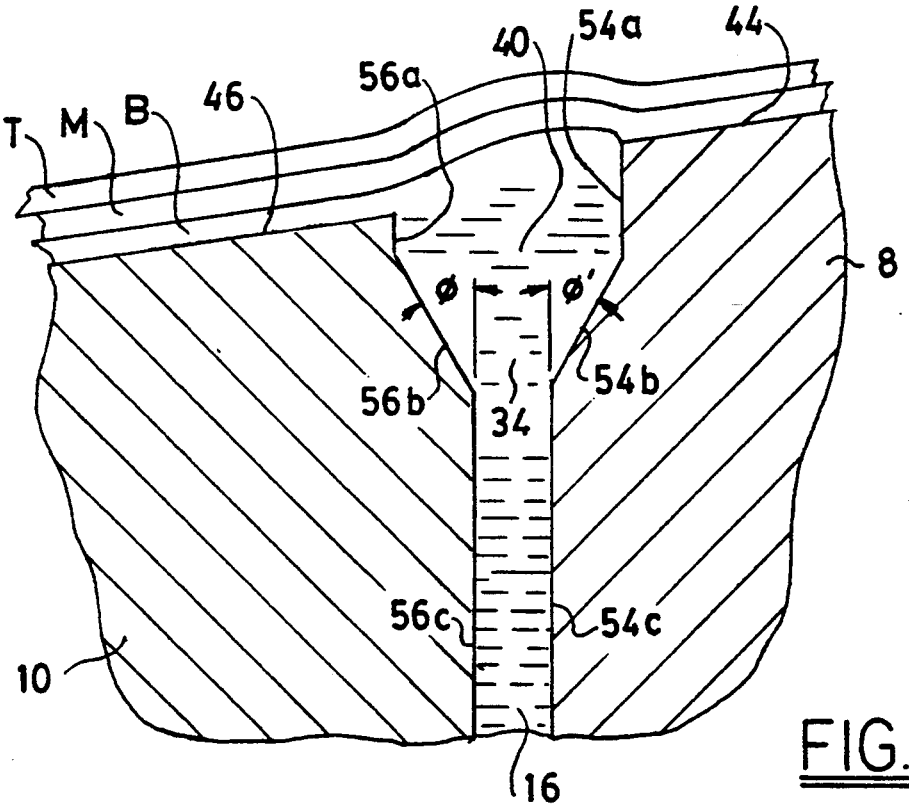
FIG. 4 is a side cross-sectional view of a third embodiment of a liquid passage system in accordance with the present invention.

FIG. 4 is a side cross-sectional view of a third embodiment of a liquid passage system in accordance with the present invention. This arrangement, in essence, combines the features of FIGS. 2 and 3. Metering slot 16 is defined by wall sections 54*c* and 56*c*, expansion section 32 is formed by wall sections 54*b* and 56*b*, while discharge slot 40 is defined by wall sections 54*a* and 56*a*.

The angles $\phi$ and $\phi'$ are 2.5° to 22.5°, preferably 12.5°. The perpendicular distance between wall sections 54*a* and 56*a* is 0.1 to 0.6 mm, preferably 0.25 mm, and is substantially constant. The perpendicular distance between wall sections 54*c* and 56*c* is 0.5 to 1.5 mm, preferably 0.9 mm, and is substantially constant. The length of wall section 56*c* between where it contacts wall section 56*b* and planar surface 46 and of wall section 54*c* between where it contacts wall section 54*b* are both 1.5 to 4.5 mm, preferably 2.7 mm. As in the embodiments of FIGS. 2 and 3, rounded transitions connect wall sections 54*c* and 56*a–c*.

Metering slots 12, 14, and 16 must be configured to hold an upstream backpressure so that liquid will spread transversely through distribution channels 24, 26, and 28, respectively, and nonuniformities can be removed. The discharge slot is of sufficient length and width to prevent vortex formation on the slide surfaces and intermixing of coating layers above the discharge slot.

The liquid passage system of the present invention has numerous advantages over prior art arrangements. It is able to handle liquid flowing at Reynolds Numbers of up to 50 without substantial vortex formation in the liquid passage system or on the downstream planar incline. This system is also able to operate without substantial interlayer mixing at similar Reynolds Numbers. The present invention also utilizes an economical and simplified structural arrangement. Moreover this arrangement can easily be retrofitted to existing coating hoppers like those disclosed by U.S. Pat. No. 3,005,440 to Padday.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A coating device adapted to apply one or more layers of photographic liquid on a web of paper or film support and including, for at least one liquid being applied to the web, a liquid passage system comprising:

a metering slot having a defined width and positioned to receive photographic liquid from a source thereof;

a longitudinally-extending expansion section connected to said metering slot to receive photographic liquid therefrom, wherein said expansion section has a width, perpendicular to the longitudinal extent of said expansion section, which increases substantially linear in size as liquid is advanced away from said metering slot; and a longitudinally-extending discharge slot connected to said expansion section to receive photographic liquid therefrom, wherein said discharge slot has a defined width, perpendicular to the longitudinal extent of said discharge slot, which is greater than the width of said metering slot and terminates together with said passage system at and is contiguous with an open layer forming surface of said passage system such that a layer of the photographic liquid is formed on the surface for application to the web.

2. A device according to claim 1, wherein said expansion section widens linearly from said metering slot to said discharge slot.

3. A device according to claim 2, wherein said expansion section widens at an angle of 5° to 45° from said metering slot.

4. A device according to claim 1, wherein said metering slot and said discharge slot have substantially constant widths.

5. A device according to claim 1, wherein the liquid passage system is located within said coating device.

6. A device according to claim 5, wherein said coating device is a slide hopper comprising:

a liquid-applying plate having an elongate planar upper surface which is inclined from horizontal and includes an application area from which coatings can be applied to the web, and a plurality of layering plates spaced and serially-arranged with respect to each other and each having a planar upper surface inclined from horizontal with one of said layering plates being adjacent said liquid-applying plate, wherein said liquid-applying plate and said plurality of layering plates are oriented to define with their upper surfaces a substantially planar incline leading to the application area, wherein said device comprises a plurality of said liquid passage systems, alternating with said layering plates each of which extend to the planar incline from a substantially opposite surface of said liquid-applying plate and said plurality of layering plates, whereby, for each said liquid passage system, a photographic liquid passes sequentially through said metering slot, said expansion section, and said discharge slot onto the inclined planar surface of the adjacent layering plate or liquid-applying plate to form a layer of that photographic liquid, such that a plurality of layers of photographic liquids builds up on the planar incline, beneath any layers formed by layering plates farther from the application area, to form a pack of discrete superimposed liquid layers which advances down the planar incline to the application area from which the pack can be applied to the web.

7. A device according to claim 6, wherein the slide hopper is configured so that a pack of photographic liquid layers is applied from the liquid-applying plate onto the web as a curtain with the application area being a lip portion from which the curtain falls.

8. A device according to claim 6, wherein each said expansion section expands in a direction toward said liquid-applying plate.

9. A device according to claim 6, wherein each said expansion section expands in a direction away from said liquid-applying plate.

10. A device according to claim 6, wherein each said expansion section expands in directions both toward and away from said liquid-applying plate.

11. A device according to claim 6, wherein the incline is at an angle of 5° to 20° from horizontal.

12. A device according to claim 1 further comprising:

an incline positioned downstream of the location where said discharge slot terminates to support the layer of the photographic liquid, wherein the liquid passage system is configured so that substantially no streak-forming vortices are formed in said liquid passage system or on said incline at Reynolds Numbers up to 50.

13. A coating device adapted to apply one or more layers of photographic liquids on a web of paper or film support and including, for one or more of the liquids being applied to the web, a liquid passage system comprising:

a metering slot positioned to receive photographic liquid from a source thereof, wherein said metering slot has a substantially constant width to smooth nonuniformities across said metering slot's longitudinal extent and to create an upstream backpressure;

a longitudinally-extending discharge slot having a substantially constant width, perpendicular to the longitudinal extent of said discharge slot, and terminating together with said passage system at and being contiguous with an open layer forming surface said passage system such that a layer of the photographic liquid is formed on the surface for application to the web, wherein said discharge slot width is greater than the width of said metering slot; and a longitudinally-extending expansion section connecting said metering slot and said discharge slot, whereby photographic liquid is conveyed from said metering slot through said expansion section to said discharge slot, wherein said liquid passage system is configured to prevent substantial vortex formation at slot Reynolds Numbers up to 50 in the liquid passage system and on the surface.

14. A device according to claim 13, wherein the liquid passage system is located within said coating device.

15. A device according to claim 14, wherein said coating device is a slide hopper comprising:

a liquid-applying plate having an elongate planar upper surface which is inclined from horizontal and includes an application area from which coatings can be applied to the web and a plurality of layering plates spaced and serially-arranged with respect to each other and each having a planar upper surface inclined from horizontal with one of said layering plates being adjacent said liquid-applying plate, wherein said liquid-applying plate and said plurality of layering plates are oriented to define with their upper surfaces a substantially planar incline leading to the application area, wherein said device comprises a plurality of said liquid passage systems, alternating with said layering plates each of which extend to the planar incline from a substantially opposite surface of said liquid-applying plate and said plurality of layering plates, whereby, for each said liquid passage system, a photographic liquid passes sequentially through said metering slot, said expansion section, and said discharge slot onto the inclined planar surface of the adjacent layering plate or liquid-applying plate to form a layer of that photographic liquid, such that a plurality of layers of photographic liquids builds up on the planar incline, beneath any layers formed by layering plates farther from the application area, to form a back of discrete superimposed liquid layers which advances down the planar incline to the application area from which the pack can be applied to the web.

16. A device according to claim 15, wherein the slide hopper is configured so that a pack of photographic liquid layers is applied from the liquid-applying plate onto the web as a curtain with the application area being a lip portion from which the curtain falls.

17. A device according to claim 15, wherein each said expansion section expands in a direction toward said liquid-applying plate.

18. A device according to claim 15, wherein each said expansion section expands in a direction away from said liquid-applying plate.

19. A device according to claim 15, wherein each said expansion section expands in directions both toward and away from said liquid-applying plate.

20. A device according to claim 15, wherein the incline is at an angle of 5° to 20° from horizontal.

* * * * *